US006870552B2

(12) United States Patent
Koyama

(10) Patent No.: US 6,870,552 B2
(45) Date of Patent: Mar. 22, 2005

(54) ADJUSTMENT OF INPUT-OUTPUT CHARACTERISTICS OF IMAGE DISPLAY APPARATUS

(75) Inventor: Fumio Koyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 503 days.

(21) Appl. No.: 10/147,054

(22) Filed: May 17, 2002

(65) Prior Publication Data

US 2002/0180677 A1 Dec. 5, 2002

(30) Foreign Application Priority Data

May 30, 2001 (JP) ..... 2001-161835

(51) Int. Cl.[7] ..... G09G 5/00
(52) U.S. Cl. ..... 345/690; 345/589; 345/600
(58) Field of Search ..... 345/204–212, 345/690–693, 600–605; G09G 5/00, 5/10, 5/02

(56) References Cited

U.S. PATENT DOCUMENTS

| | | | | | |
|---|---|---|---|---|---|
| 5,768,410 | A | * | 6/1998 | Ohta et al. | 382/162 |
| 5,896,122 | A | * | 4/1999 | MacDonald et al. | 345/602 |
| 6,344,857 | B1 | * | 2/2002 | Matono et al. | 345/600 |
| 6,801,212 | B1 | * | 10/2004 | Eldredge | 345/589 |

FOREIGN PATENT DOCUMENTS

| | | | | | |
|---|---|---|---|---|---|
| JP | A 6-324657 | | | 11/1994 | |
| JP | A 7-225575 | | | 8/1995 | |
| JP | 09016756 | A | * | 1/1997 | G06T/1/00 |
| JP | 10020842 | A | * | 1/1998 | G09G/5/06 |
| JP | A 11-109927 | | | 4/1999 | |
| JP | 11288241 | A | * | 10/1999 | G09G/3/20 |
| JP | A 2000-83165 | | | 3/2000 | |
| JP | A 2000-333194 | | | 11/2000 | |
| JP | A 2001-83953 | | | 3/2001 | |
| JP | 2003076347 | A | * | 3/2003 | G09G/5/00 |

* cited by examiner

*Primary Examiner*—Alexander Eisen
(74) *Attorney, Agent, or Firm*—Oliff & Berridge, PLC

(57) ABSTRACT

A former stage signal adjustment module included in a signal adjustment device has a signal conversion sub-module, a first lookup table, and an interpolation sub-module. The signal conversion sub-module outputs an upper q-bit color video signal, where q is an integer of not less than 1 and not greater than (p−1), in response to input of a p-bit color video signal, where p is an integer of not less than 2. The first lookup table stores information representing a mapping of a tone value expressed by the upper q-bit color video signal to an r-bit tone value set according to first adjustment information regarding a predetermined characteristic, where r is an integer of not less than p. The first lookup table outputs, in response to input of the upper q-bit color video signal from the signal conversion sub-module, an r-bit first reference signal, which represents a lower tone value than a tone value corresponding to the p-bit color video signal, and an r-bit second reference signal, which represents a higher tone value than the tone value corresponding to the p-bit color video signal. The interpolation sub-module interpolates and generates an r-bit former stage-adjusted video signal corresponding to the p-bit color video signal, based on the first reference signal and the second reference signal. This arrangement of the present invention desirably ensures a high-quality resulting image without lengthening a processing time required for modifying the lookup tables of the respective colors.

12 Claims, 11 Drawing Sheets

Fig.7(a) DI[9:0]
Fig.7(b) DI[9:5]
Fig.7(c) DIC[5:0]
Fig.7(d) DR[9:0]
Fig.7(e) LTCK
Fig.7(f) DR1LT[9:0]
Fig.7(g) DR1[9:0]
Fig.7(h) DR2[9:0]
T
011h
3EDh
00h
1Fh
T/2
T/2
+1
+1
00h
01h
1Fh
20h
T

ADJUSTMENT OF INPUT-OUTPUT CHARACTERISTICS OF IMAGE DISPLAY APPARATUS

BACKGROUND OF THE INVENTION

1. Field of the Invention

The present invention relates to a technique of adjusting the input-output characteristics of an image display apparatus.

2. Description of the Related Art

An image display apparatus like a projector has a signal adjustment device, which adjusts a tone characteristic of an input video signal, in order to correct a non-linear input-output characteristic of the image display apparatus due to a non-linear input-output characteristic (V-T characteristic) of an image display device, such as a liquid crystal panel. The signal adjustment device adjusts the tone characteristic of the input video signal and the input-output characteristic of the image display apparatus, thus attaining adjustment of the contrast, the brightness, and the color tone of a resulting displayed image. The signal adjustment device utilizes three lookup tables to adjust the input-output characteristic of the image display apparatus. Each of the three lookup tables has information representing a mapping of a linear tone value of each color video signal, red (R), green (G), or blue (B) to a tone value corresponding to the adjusted input-output characteristic of the image display apparatus.

A controller connecting with three RAMs writes the information representing the mapping into the three lookup tables.

Each lookup table outputs a color video signal having a tone value corresponding to the tone value of the color video signal input as an address signal of the RAM during a normal image display operation.

In order to adjust the input-output characteristic of the image display apparatus with a high accuracy and attain a high-quality resulting image, it is preferable that the color video signal used as the address signal in each lookup table and the corresponding output color video signal have a greater number of tones. The lookup table thus tends to extend the data width from the conventional 8-bit data to 10-bit data.

The greater input-output data width of the lookup table, however, enhances the quantity of information (quantity of data) included in the lookup table and undesirably lengthens the processing time required for updating and modifying the lookup table. Especially in the case where multiple different processes of adjustment are carried out with regard to the input-output characteristic of the image display apparatus, the information of the lookup table should be computed based on respective pieces of adjustment information. This further increases the processing time required for updating and modifying the lookup table.

The user may desire to change the contrast, the brightness, or the color of the image in the process of displaying the image. In such cases, the lookup tables of the respective colors should be modified. When the lookup table stores the large quantity of information, the processing time required for modifying the lookup tables is undesirably lengthened.

SUMMARY OF THE INVENTION

The object of the present invention is thus to solve the problem arising in the prior art technique discussed above and to provide a technique that ensures a high-quality resulting image without lengthening a processing time required for modifying lookup tables.

At least part of the above and the other related objects is attained by an image display apparatus that displays an image based on an input video signal. The image display apparatus includes: a signal adjustment device that adjusts a tone characteristic of the input video signal and outputs an adjusted video signal; and an electro-optic device that outputs image light representing the image in response to the adjusted video signal supplied from the signal adjustment device. The signal adjustment device has a former stage signal adjustment module including first through third former stage color signal adjustment modules, and a latter stage signal adjustment module including first through third latter stage color signal adjustment modules. The first through third former stage color signal adjustment modules respectively adjust tone characteristics of first through third color video signals, which are constituents of the input video signal, based on first adjustment information regarding an input-output characteristic of the image display apparatus. The first through third latter stage color signal adjustment modules respectively adjust tone characteristics of first through third former stage-adjusted color video signals supplied from the first through the third former stage color signal adjustment modules, based on second adjustment information regarding the input-output characteristic of the image display apparatus. Each of the first through the third former stage color signal adjustment modules includes: a signal conversion sub-module that outputs an upper q-bit color video signal, where q is an integer of not less than 1 and not greater than (p−1), in response to input of a corresponding p-bit color video signal, where p is an integer of not less than 2; a first lookup table that stores information representing a mapping of a tone value expressed by the upper q-bit color video signal to an r-bit tone value set according to the first adjustment information, where r is an integer of not less than p, the first lookup table outputting, in response to input of the upper q-bit color video signal from the signal conversion sub-module, an r-bit first reference signal, which represents a lower tone value than a tone value corresponding to the p-bit color video signal, and an r-bit second reference signal, which represents a higher tone value than the tone value corresponding to the p-bit color video signal; and an interpolation sub-module that interpolates and generates an r-bit former stage-adjusted color video signal corresponding to the p-bit color video signal, based on the first reference signal and the second reference signal. Each of the first through the third latter stage color signal adjustment modules includes a second lookup table that stores information representing a mapping of an r-bit tone value expressed by the former stage-adjusted color video signal supplied from its corresponding former stage color signal adjustment module to an r-bit tone value set according to the second adjustment information.

In the construction of the image display apparatus of the present invention, the first lookup table provided in each of the first through the third former stage color signal adjustment modules has the information representing the mapping of the tone value expressed by the upper q-bit color video signal to the r-bit tone value set according to the first adjustment information (where r is an integer of not less than p). Compared with the prior art structure where each of the first lookup tables has information representing a mapping of a tone value expressed by the p-bit color video signal to the r-bit tone value set according to the first adjustment information, this arrangement desirably decreases the total quantity of information and thereby effectively shortens the processing time required for updating and modifying the information included in each of the first lookup tables.

In the above construction, the interpolation sub-module provided in each of the first through the third former stage color signal adjustment modules interpolates and generates the r-bit former stage-adjusted color video signal corresponding to the p-bit color video signal, based on the r-bit first reference signal, which represents a lower tone value than the tone value corresponding to the p-bit color video signal, and the r-bit second reference signal, which represents a higher tone value than the tone value corresponding to the p-bit color video signal. This arrangement enables the tone characteristics of the first through the third color video signals to be adjusted effectively with a high accuracy.

The arrangement of the image display apparatus effectively ensures a high-quality resulting image without lengthening the processing time required for updating and modifying the first lookup tables provided in the first through the third former stage color signal adjustment modules.

In accordance with one preferable application, the image display apparatus is further provided with an adjustment controller that controls the signal adjustment device. The former stage signal adjustment module includes: four former stage color signal adjustment modules that are usable to adjust the first through the third color video signals constituting the input video signal; an input signal selection sub-module that selects the first through the third color video signals as input signals to arbitrary three former stage color signal adjustment modules, which are selected among the four former stage color signal adjustment modules, in response to a preset selection signal output from the adjustment controller; and an output signal selection sub-module that selects three output signals from the three former stage color signal adjustment modules, which have received the input of the first through the third color video signals, as the first through the third former stage-adjusted color video signals in response to the preset selection signal.

In this application, in the state of normal operations, three former stage color signal adjustment modules are selected among the four former stage color signal adjustment modules and utilized as the first through the third former stage color signal adjustment modules corresponding to the first through the third color video signals, whereas one remaining former stage color signal adjustment module is not utilized (that is, in a vacant state). The first lookup table provided in each of the three former stage color signal adjustment modules selected as the first through the third former stage color signal adjustment modules is updated, for example, by the procedure discussed below.

The first lookup table of a specific color to be updated is set in the remaining former stage color signal adjustment module in the vacant state. This makes the former stage color signal adjustment module, in which the non-updated, old first lookup table of the specific color has been set, fall in the vacant state. Repeating this process updates all the first lookup tables corresponding to the respective colors.

The procedure utilizes the former stage color signal adjustment module in the vacant state to update the first lookup table for each color. This arrangement enables the lookup tables to be updated without causing superposition of noise on a displayed image or an extreme change in color of the displayed image during the display operation of the image display apparatus.

It is preferable that the second adjustment information is utilized to correct a non-linear input-output characteristic of the image display apparatus, which arises due to a non-linear input-output characteristic intrinsic to the electro-optic device.

It is also preferable that the first adjustment information is utilized to correct the input-output characteristic of the image display apparatus, in order to attain a user's desired property relating to the image displayed by the image display apparatus.

The user's desired property includes at least one property among contrast, brightness, and color of the image displayed by the image display apparatus. Here the color may represent a color density, a hue, a color tone, or the like.

The present invention is also directed to a signal adjustment device that adjusts an input video signal. The signal adjustment device has a former stage signal adjustment module including first through third former stage color signal adjustment modules, and a latter stage signal adjustment module including first through third latter stage color signal adjustment modules. The first through third former stage color signal adjustment modules respectively adjust tone characteristics of first through third color video signals, which are constituents of the input video signal, based on first adjustment information regarding a predetermined characteristic. The first through third latter stage color signal adjustment modules respectively adjust tone characteristics of first through third former stage-adjusted color video signals supplied from the first through the third former stage color signal adjustment modules, based on second adjustment information regarding the predetermined characteristic. Each of the first through the third former stage color signal adjustment modules includes: a signal conversion sub-module that outputs an upper q-bit color video signal, where q is an integer of not less than 1 and not greater than (p−1), in response to input of a corresponding p-bit color video signal, where p is an integer of not less than 2; a first lookup table that stores information representing a mapping of a tone value expressed by the upper q-bit color video signal to an r-bit tone value set according to the first adjustment information, where r is an integer of not less than p, the first lookup table outputting, in response to input of the upper q-bit color video signal from the signal conversion sub-module, an r-bit first reference signal, which represents a lower tone value than a tone value corresponding to the p-bit color video signal, and an r-bit second reference signal, which represents a higher tone value than the tone value corresponding to the p-bit color video signal; and an interpolation sub-module that interpolates and generates an r-bit former stage-adjusted color video signal corresponding to the p-bit color video signal, based on the first reference signal and the second reference signal. Each of the first through the third latter stage color signal adjustment modules includes a second lookup table that stores information representing a mapping of an r-bit tone value expressed by the former stage-adjusted color video signal supplied from its corresponding former stage color signal adjustment module to an r-bit tone value set according to the second adjustment information.

In accordance with one preferable application, the former stage signal adjustment module includes: four former stage color signal adjustment modules that are usable to adjust the first through the third color video signals constituting the input video signal; an input signal selection sub-module that selects the first through the third color video signals as input signals to arbitrary three former stage color signal adjustment modules, which are selected among the four former stage color signal adjustment modules, in response to a preset selection signal output from the adjustment controller; and an output signal selection sub-module that selects three output signals from the three former stage color signal adjustment modules, which have received the input of the first through the third color video signals, as the first through the third former stage-adjusted color video signals in response to the preset selection signal.

Application of the signal adjustment device of the present invention to any image display apparatus exerts the similar functions and effects to those of the image display apparatus of the present invention discussed above.

These and other objects, features, aspects, and advantages of the present invention will become more apparent from the following detailed description of the preferred embodiment with the accompanying drawings.

DESCRIPTION OF THE PREFERRED EMBODIMENTS

Figure 1:
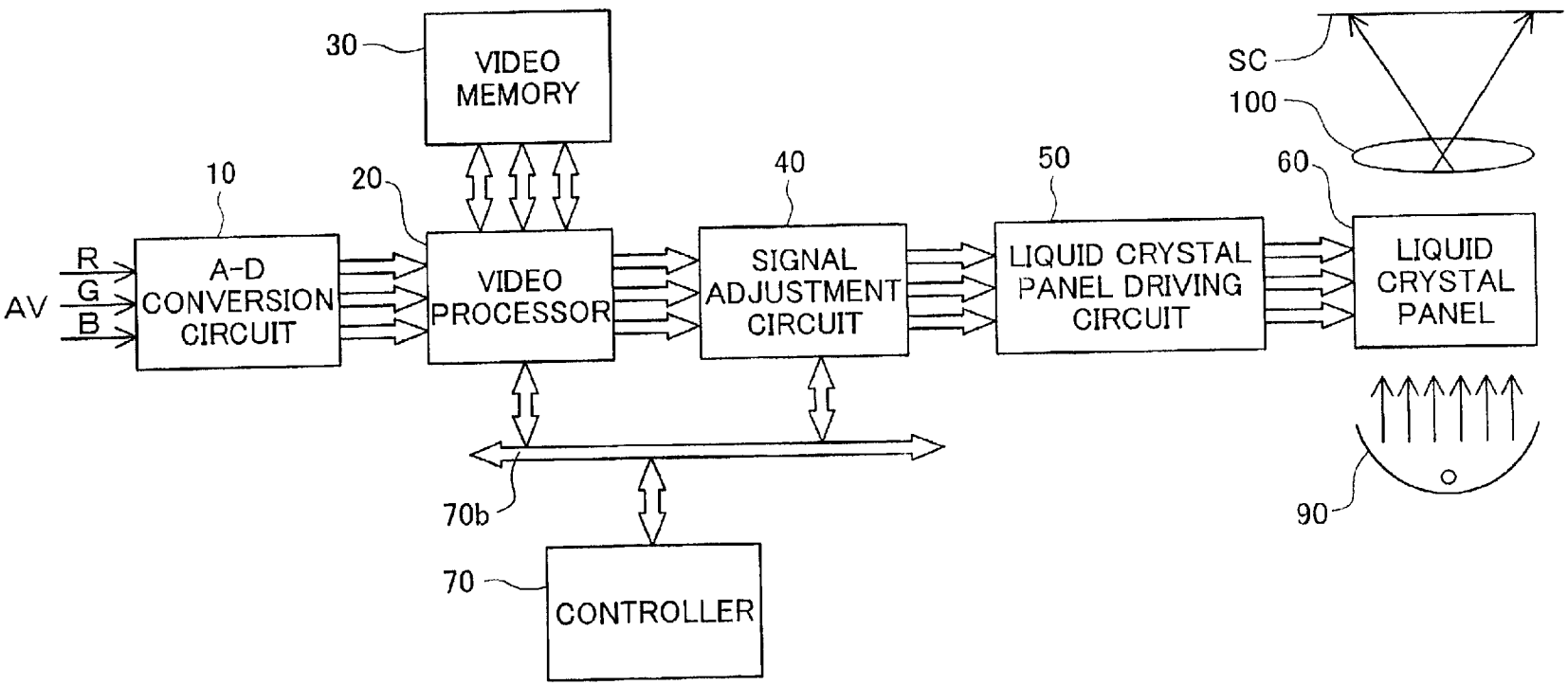
FIG. 1 is a block diagram illustrating the general construction of an image display apparatus, to which a signal adjustment device of the present invention is applied.

Some modes of carrying out the invention are discussed below as preferred embodiments in the following sequence:

A. General Construction of Image Display Apparatus
B. Signal Adjustment Circuit of First Embodiment
  B1. Latter Stage Signal Adjustment Module
  B2. Former Stage Signal Adjustment Module
  B3. Modifications of Former Stage Signal Adjustment Module
    B3-1. First Modified Example
    B3-2. Second Modified Example
C. Signal Adjustment Circuit of Second Embodiment
  C1. Former Stage Signal Adjustment Module
  C2. Settings of Lookup Table
D. Other Applications A. General Construction of Image Display Apparatus FIG. 1 is a block diagram illustrating the general construction of an image display apparatus, to which a signal adjustment device of the present invention is applied.

The image display apparatus includes an A-D conversion circuit 10, a video processor 20, and a video memory 30 functioning as an image processing module, a signal adjustment circuit 40 functioning as a signal adjustment device, a liquid crystal panel driving circuit 50 and a liquid crystal panel 60 functioning as an image display module, and a controller 70 functioning as an adjustment controller. The video processor 20 and the signal adjustment circuit 40 are connected to the controller 70 via a bus 70*b*. The controller 70 includes a CPU, a RAM, and a ROM and controls operations of the video processor 20 and the signal adjustment circuit 40 according to data stored in the ROM. The controller 70 is also in charge of various settings in the video processor 20 and the signal adjustment circuit 40 according to the data stored in the ROM. For example, the controller 70 stores lookup tables for colors R, G, and B into the signal adjustment circuit 40.

This image display apparatus is a projector. The image display module includes a lighting unit 90 that illuminates the liquid crystal panel 60, and a projection optical system 100 that projects image light (light representing an image), which is emitted from the liquid crystal panel 60, onto a screen SC. The liquid crystal panel 60 is one example of an electro-optic device that modulates the illumination light emitted from the lighting unit 90 according to an input video signal and outputs the modulated light (also referred to as the 'image light' representing the image).

Although not being specifically illustrated here, the liquid crystal panel 60 actually has three liquid crystal panels for the colors R, G, and B. The lighting unit 90 has a color ray separation optical system that divides white light into three color rays. The projection optical system 100 has a composite optical system that combines the three color rays transmitted from the liquid crystal panel 60. The construction of the optical system in such a projector is discussed in detail, for example, in JAPANESE PATENT LAID-OPEN GAZETTE No. 10-171045 disclosed by the applicant of the present invention, and is thus not specifically described here.

The liquid crystal panel 60 may be one color liquid crystal panel. In one possible application, the image display apparatus may be a direct vision-type image display apparatus, which has no projection optical system but utilizes one color liquid crystal panel as the liquid crystal panel 60.

The A-D conversion circuit 10 converts R, G, B color video signals included in an input analog video signal AV into digital color video signals.

The video processor 20 writes the digital color video signals of the respective colors input from the A-D conversion circuit 10 into the video memory 30, and reads the data stored in the video memory 30 as the color video signals of the respective colors. The video processor 20 carries out diverse series of image processing, for example, expansion or contraction of the image, in these writing and reading processes.

The signal adjustment circuit 40 adjusts the tone characteristics of the R, G, B color video signals input from the video processor 20. The respective color video signals output from the signal adjustment circuit 40 (that is, the adjusted color video signals) are supplied to the liquid crystal panel driving circuit 50. The liquid crystal panel driving circuit 50 generates a driving signal in response to each of the supplied color video signals to actuate the liquid crystal panel 60. The liquid crystal panel 60 modulates the illumination light emitted from the lighting unit 90 in response to the driving signal. The modulated light is projected as the image light onto the screen SC via the projection optical system 100. A resulting image is thus displayed on the screen SC.

The image display apparatus of the embodiment is mainly characterized by the signal adjustment circuit 40. The following describes the details of the signal adjustment circuit 40.

B. Signal Adjustment Circuit of First Embodiment

Figure 2:
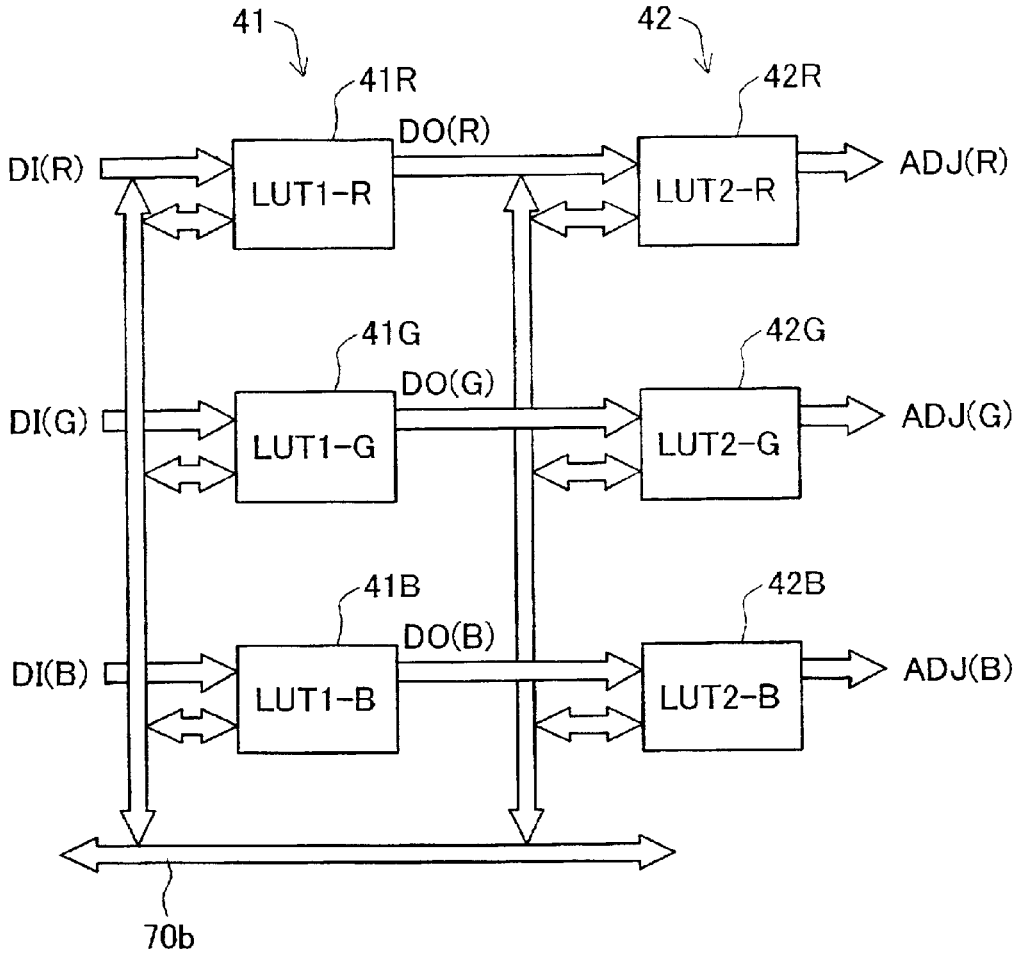
FIG. 2 is a block diagram illustrating the internal structure of a signal adjustment circuit 40 in a first embodiment.

FIG. 2 is a block diagram illustrating the internal structure of the signal adjustment circuit 40 in a first embodiment. The signal adjustment circuit 40 has two-stage signal adjustment modules, that is, a former stage signal adjustment module 41 and a latter stage signal adjustment module 42.

The former stage signal adjustment module 41 includes three former stage color signal adjustment modules 41R, 41G, and 41B, which respectively adjust the tone characteristics of input three RGB color video signals DI(R), DI(G), and DI(B). The latter stage signal adjustment module 42 includes three latter stage color signal adjustment modules 42R, 42G, and 42B, which respectively adjust the tone characteristics of former stage-adjusted color video signals DO(R), DO(G), and DO(B) supplied from the respective former stage color signal adjustment modules 41R, 41G, and 41B. The respective blocks 41R, 41G, 41B, 42R, 42G, and 42B are connected to the bus 70*b*. The tone characteristics of the respective R, G, B color video signals are independently adjusted by the corresponding former stage color signal adjustment modules 41R, 41G, and 41B and the corresponding latter stage color signal adjustment modules 42R, 42G, and 42B.

B1. Latter Stage Signal Adjustment Module

The three latter stage color signal adjustment modules 42R, 42G, and 42B, which constitute the latter stage signal adjustment module 42, have an identical construction. The following mainly regards the latter stage color signal adjustment module 42R for the color R.

Figure 3:
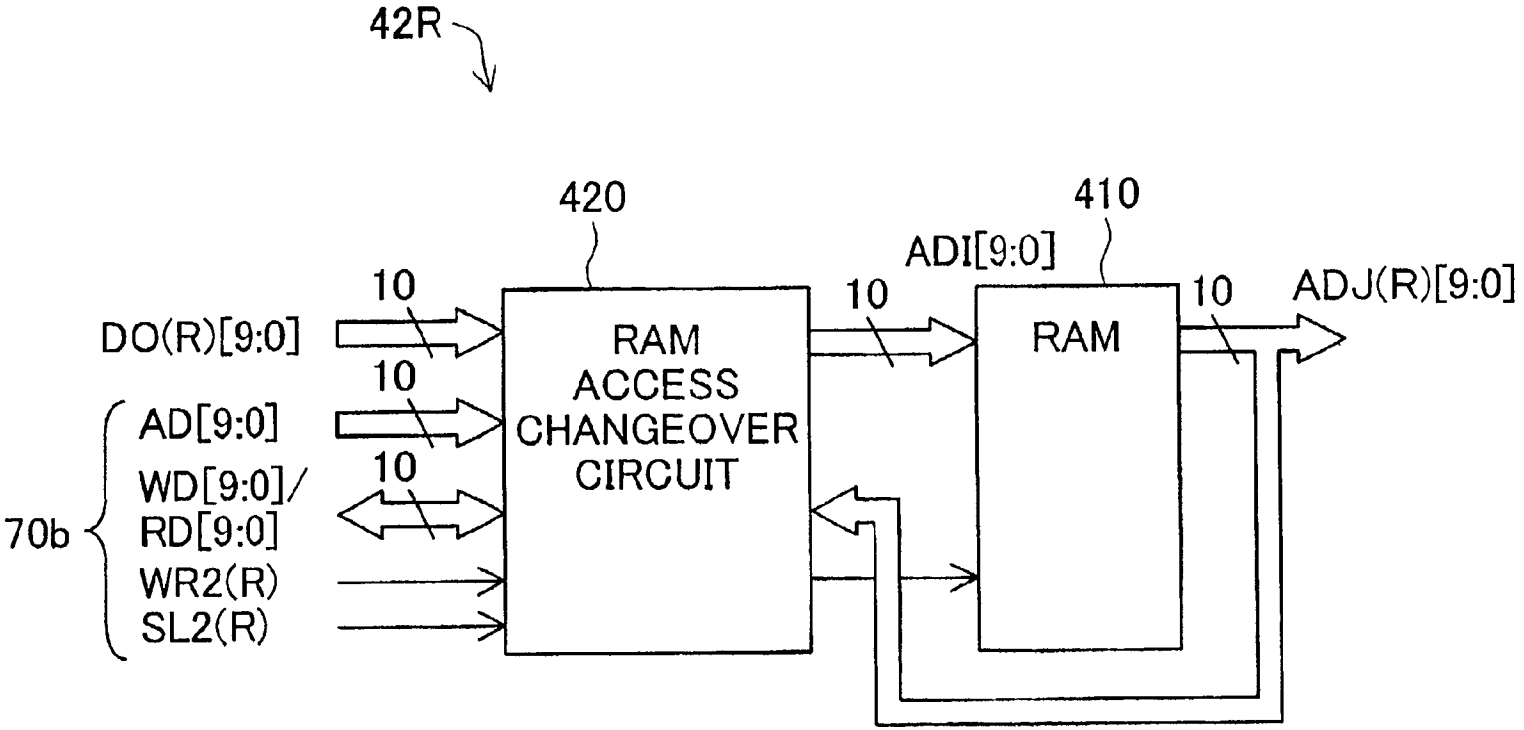
FIG. 3 shows the functionality of a latter stage color signal adjustment module 42R for a color R.

FIG. 3 shows the functionality of the latter stage color signal adjustment module 42R for the color R. This latter stage color signal adjustment module 42R includes one RAM 410 and an access changeover circuit 420.

The access changeover circuit 420 selects either one of the former stage-adjusted color video signal DO(R) [9:0] supplied from the former stage color signal adjustment module 41R and an address signal AD[9:0] supplied via an address bus of the bus 70*b* as an input address signal ADI[9:0] of the RAM 410, in response to an access changeover signal SL2(R). The numerals in the brackets [ ] after each signal name represent the data width of the signal. For example, [9:0] represents the 10-bit data width where the lower most bit number is 0 and the upper most bit number is 9 bits. The data width may be omitted in the following explanation. The symbol (R) after each signal name represents the corresponding color. This symbol may also be omitted in the following explanation.

When the former stage-adjusted color video signal DO(R) is selected as the input address signal ADI, a reading operation from the RAM 410 is performed in response to a read-write signal WR2(R), and a latter stage-adjusted color video signal ADJ(R) is output. The latter stage-adjusted color video signal ADJ(R) is specified as an adjusted color video signal of the color R output from the signal adjustment circuit 40.

When the address signal AD is selected as the input address signal ADI, a reading or writing operation from or into the RAM 410 is performed in response to the read-write signal WR2(R).

In the process of the writing operation, a write data signal WD supplied via a data bus of the bus 70*b* is written at an address specified by the input address signal ADI of the RAM 410. In the process of the reading operation, data written at the address specified by the input address signal ADI of the RAM 410 and is output via the access changeover circuit 420 to the data bus of the bus 70*b* as a read data signal RD.

Information on the tone characteristic is written as the lookup tables into the RAM 410, in order to correct a non-linear input-output characteristic of the image display apparatus arising due to a non-linear input-output characteristic intrinsic to the liquid crystal panel 60.

As mentioned previously, the other latter stage color signal adjustment modules 42G and 42B have similar configurations to that of the latter stage color signal adjustment module 42R for the color R. Independent read-write signals WR2(G) and WR2(B) and access changeover signals SL2(G) and SL2(B) are input into the respective blocks 42G and 42B as the read-write signal and the access changeover signal supplied via the bus 70*b*. Former stage-adjusted color video signals DO(G) and DO(B) output from the former stage color signal adjustment modules 41G and 41B are input into the corresponding latter stage color signal adjustment modules 42G and 42B.

B2. Former Stage Signal Adjustment Module

The three former stage color signal adjustment modules 41R, 41G, and 41B, which constitute the former stage signal adjustment module 41, have an identical construction. The following mainly regards the former stage color signal adjustment module 41R for the color R.

Figure 4:
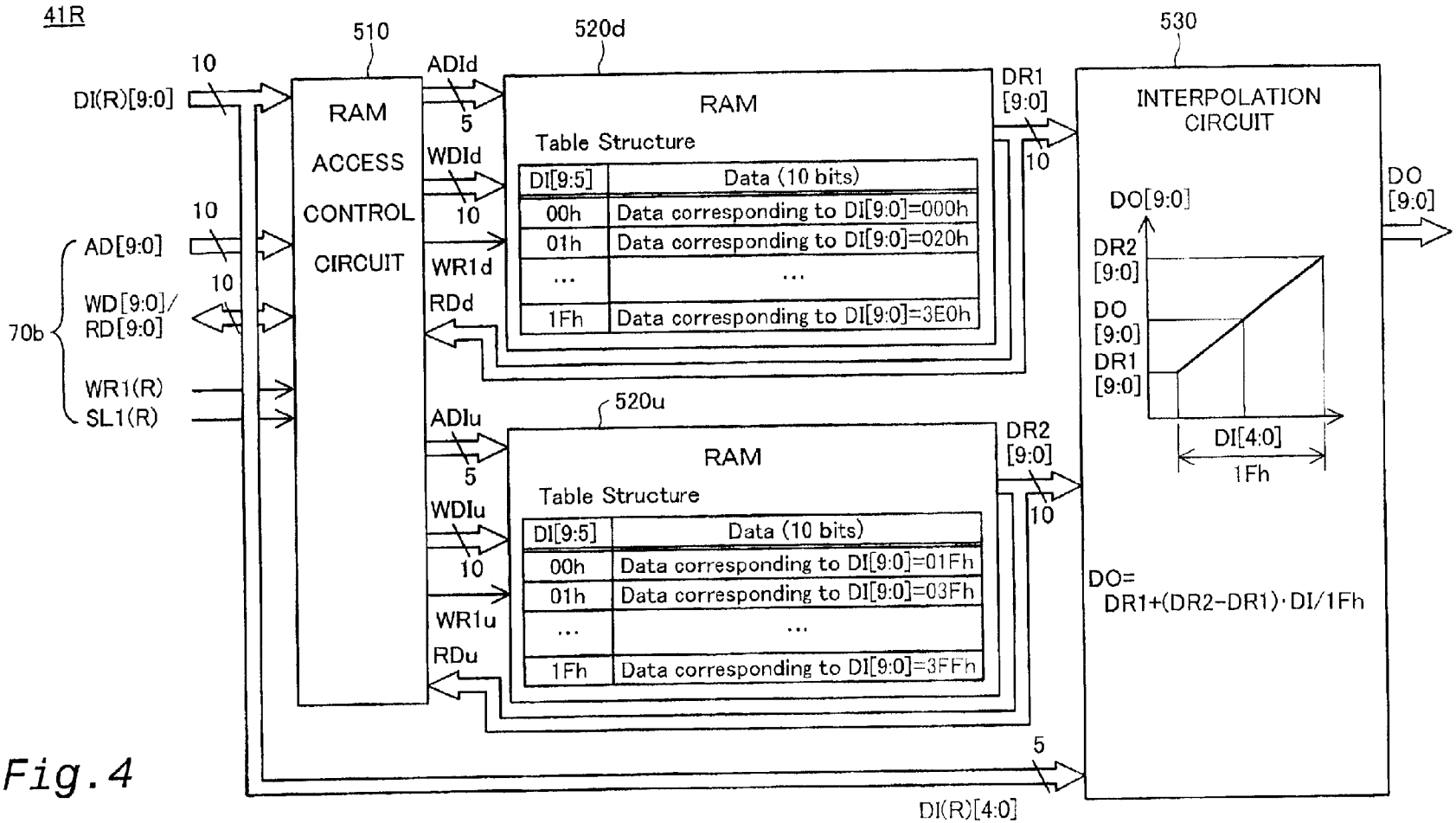
FIG. 4 shows the functionality of a former stage color signal adjustment module 41R for the color R.

FIG. 4 shows the functionality of the former stage color signal adjustment module 41R for the color R. This former stage color signal adjustment module 41R includes an access control circuit 510, two RAMs 520*u* and 520*d*, and an interpolation circuit 530.

The access control circuit 510 selects either one of the R color video signal DI(R) and the address signal AD supplied via the bus 70*b*, in response to an access changeover signal SL1(R). Namely the access control circuit 510 selects either access to the two RAMs 520*u* and 520*d* with the R color video signal DI(R) or access to the two RAMs 520*u* and 520*d* with the address signal AD, according to the access changeover signal SL1(R).

The two RAMs 520*d* and 520*u* respectively receive 5-bit input address signals ADId and ADIu input from the access control circuit 510.

The color video signal DI and the address signal AD have the 10-bit data width. The access control circuit 510 accordingly outputs upper 5 bits of either the color video signal DI or the address signal AD selected in response to the access changeover signal SL1, as the input address signals ADId and ADIu.

The description first regards selection of the access with the color video signal DI. In response to selection of the access with the color video signal DI, the upper 5 bits of the color video signal DI [9:5] is output as the input address signals ADId [4:0] and ADIu [4:0]. A read-write signal WR1 is output from the access control circuit 510 as two read-write signals WR1*d* and WR1*u*. The access control circuit 50 corresponds to the signal conversion sub-module of the present invention.

Data specified by the input address signals ADId and ADIu are read from the two RAMs 520*d* and 520*u* in response to the corresponding read-write signals WR1*d* and WR1*u*. The read-out data are output as 10-bit reference data signals DR1 [9:0] and DR2 [9:0].

Adjustment data corresponding to a case where an upper 5-bit color video signal DI [9:5] has an identical value and a lower 5-bit color video signal DI [4:0] takes a minimum value '00h' (where 'h' is a symbol representing hexadecimal notation) and adjustment data corresponding to another case where the lower 5-bit color video signal DI [4:0] takes a maximum value '1Fh' are stored at an identical address of the two RAMs 520*d* and 520*u*. For example, when the value of the upper 5-bit color video signal DI [9:5] as the input address signals ADId and ADIu is '00h', 10-bit adjustment data in which the lower 5 bits DI [4:0] corresponds to '00h' or the color video signal DI [9:0] corresponds to '000h' is stored at the address of the RAM 520*d* in which the value of the input address signal ADId corresponds to '00h'. Similarly 10-bit adjustment data in which the lower 5 bits DI [4:0] corresponds to '1Fh' or the color video signal DI [9:0] corresponds to '01Fh' is stored in the RAM 520*u*.

The two reference data signals DRI [9:0] and DR2 [9:0] read from the two RAMs 520*d* and 520*u* and the lower 5 bits DI [5:0] of the color video signal DI is input into the interpolation circuit 530.

The interpolation circuit 530 generates data corresponding to the color video signal DI from the respective values of the two reference data signals DR1 and DR2 and the value of the lower 5-bit color video signal DI [4:0] according to a computing equation of linear interpolation given below. This interpolation circuit 530 corresponds to the interpolation sub-module of the present invention. The data thus generated is outputs as the former stage-adjusted color video signal DO [9:0].

$$DO=DR1\,[9:0]+(DR2\,[9:0]-DR1\,[9:0])\cdot DI\,[4:0]/(01Fh) \quad (1)$$

The following description regards selection of the access with the address signal AD. In the case of selection of the access with the address signal AD, the upper 5 bits of the address signal AD is output as the input address signals ADId and ADIu. The read-write signal WR1 is output from the access control circuit 510 as the two read-write signals WR1*d* and WR1*u*. Data are read from or written at the addresses specified by the input address signals ADId and ADIu in the two RAMs 520*d* and 520*u*, in response to the corresponding read-write signals WR1*d* and WR1*u*.

The access to either of the two RAMs 520*d* and 520*u* is selected according to the value of the lower 5 bits of the address signal AD. More specifically, when the lower 5 bits of the address signal AD [4:0] is '00h', the access to the first RAM 520*d* is selected. An upper 5-bit address signal AD[9:5] is output as the input address signal ADId, while the read-write signal WR1*d* is output corresponding to the read-write signal WR1(R). During the writing operation, write data WD [9:0] supplied via the data bus of the bus 70*b* is output as write data WDId. When the lower 5 bits of the address signal AD [4:0] is '01h', the access to the second RAM 520*u* is selected. The upper 5-bit address signal AD [9:5] is output as the input address signal ADIu, while the read-write signal WR1*u* is output corresponding to the read-write signal WR1(R). During the writing operation, the write data WD [9:0] supplied via the data bus of the bus 70*b* is output as write data WDIu.

In the process of the writing operation into the first RAM 520*d*, the write data WDId is written at the address specified by the input address signal ADId. In the process of the reading operation, data is read from the address specified by the input address signal ADId and output via the access control circuit 510 to the data bus of the bus 70*b* as a read data signal RD. This procedure is also adopted in reading and writing operations from and into the second RAM 520*u*.

Tone characteristic information, which is used to correct the input-output characteristic of the image display apparatus according to the contrast, the brightness, and the color of the image, is written as lookup tables into the two RAMs 520*d* and 520*u*. The lookup tables written in the two RAMs 520*d* and 520*u* correspond to the first lookup table of the present invention.

The other former stage color signal adjustment modules 41G and 41B have similar configurations to that of the former stage color signal adjustment module 41R for the color R. Independent read-write signals WR1(G) and WR1(B) and access changeover signals SL1(G) and SL1(B) are input into the respective blocks 41G and 41B as the read-write signal and the access changeover signal supplied via the bus 70*b*.

As described above, in each of the former stage color signal adjustment modules 41R, 41G, and 41B, the upper 5-bit color video signal out of the input 10-bit color video signal is specified as the input address signals ADId and ADIu, and the two RAMS 520*d* and 520*u* function as the lookup tables to generate the 10-bit output signals DR1 and DR2 corresponding to the input address signals ADId and ADIu. Compared with the prior art structure where one RAM functions as a lookup table to generate the 10-bit output signal corresponding to the 10-bit input address signal, this arrangement requires a smaller memory capacity for the lookup tables. This relatively shortens the processing time required for updating and modifying the lookup tables.

The procedure interpolates the color video signal having a tone that is not written in the lookup table by utilizing the data stored in the lookup table and thereby generates the corresponding output signal. This accordingly ensures a high-quality resulting image.

As discussed above, in the signal adjustment circuit 40 of this embodiment, the former stage signal adjustment module 41 adjusts the contrast, the brightness, the color, and the other factors of the image that may be changed during an image display operation. The latter stage signal adjustment module 42 adjusts the non-linear input-output characteristic intrinsic to the liquid crystal panel 60. The construction of the embodiment enables the contrast, the brightness, the color, and the other factors of the image that may be changed during an image display operation to be changed within a relatively short time period. This arrangement also ensures adjustment to a relatively high quality.

This embodiment regards the construction for respectively adjusting the R, G, and B color video signals. A similar construction is also applicable to adjust monochromatic video signals. In the latter case, the former stage signal adjustment module and the latter stage signal adjustment module respectively require only one former stage color signal adjustment module and only one latter stage color signal adjustment module.

B3. Modifications of Former Stage Signal Adjustment Module

The former stage color signal adjustment modules 41R, 41G, and 41B constituting the former stage signal adjustment module 41 may have any of other structures discussed below as modified examples.

B3-1. First Modified Example

Figure 5:
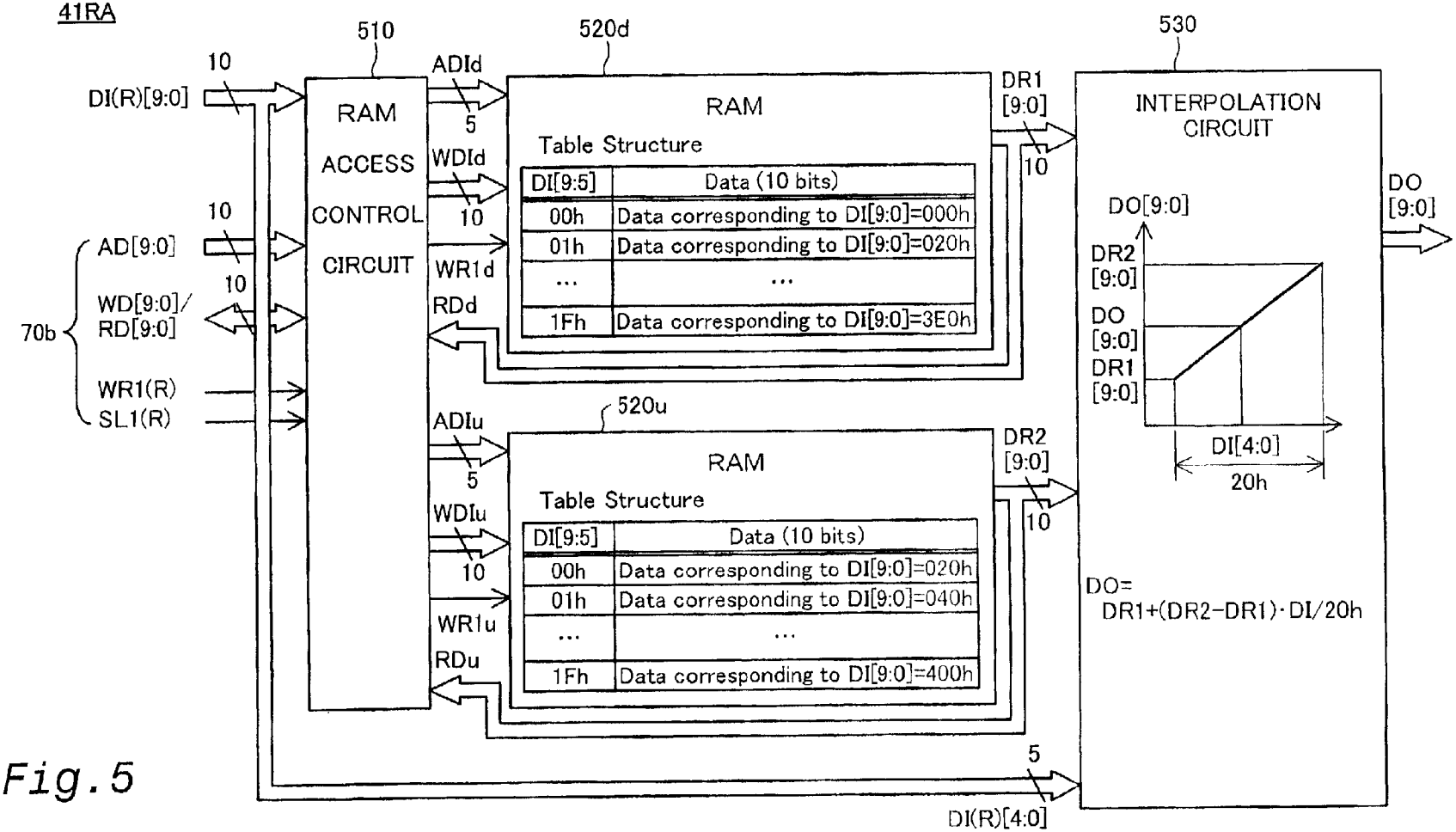
FIG. 5 shows the functionality of another former stage color signal adjustment module 41RA for the color R in a first modified example.

FIG. 5 shows the functionality of another former stage color signal adjustment module 41RA for the color R in a first modified example. The construction of the former stage color signal adjustment module 41RA is similar to the construction of the former stage color signal adjustment module 41R of the first embodiment, except the data structure stored in the RAM 520*u* and the computing equation adopted in the interpolation circuit 530 as given below:

$$DO=DR1\,[9:0]+(DR2\,[9:0]-DR1\,[9:0])\cdot DI\,[4:0]/(020h) \quad (2)$$

As shown in FIG. 4, the RAM 520*u* in the former stage color signal adjustment module 41R of the first embodiment stores the data corresponding to the signal having a greater value of the 10-bit color video signal DI by '01Fh' than that of the data stored at the same address in the RAM 520*d*. In this case, the two reference data signals DR1 and DR2 output from the two RAMs 520*d* and 520*u* has the difference '1Fh', which is equal to '31' in decimal notation. This leads to the rather complicated circuit structure for the division '/(1Fh)' of the above Equation (1) executed in the interpolation circuit 530.

As shown in FIG. 5, the RAM 520*u* in the former stage color signal adjustment module 41RA of this modified example, on the other hand, stores the data corresponding to the signal having a greater value of the 10-bit color video signal DI by '020h' than that of the data stored at the same address in the RAM 520*d*. In this case, the two reference data signals DR1 and DR2 output from the two RAMs 520*d* and 520*u* has the difference '20h', which is equal to '32' in decimal notation. This leads to a relatively simple shift operation circuit structure for the division '/(20h)' of the above Equation (2) executed in the interpolation circuit 530.

As discussed above, the simple construction of the interpolation circuit 530 is one advantage of the former stage color signal adjustment module 41RA of this modified example.

B3-2. Second Modified Example

Figure 6:
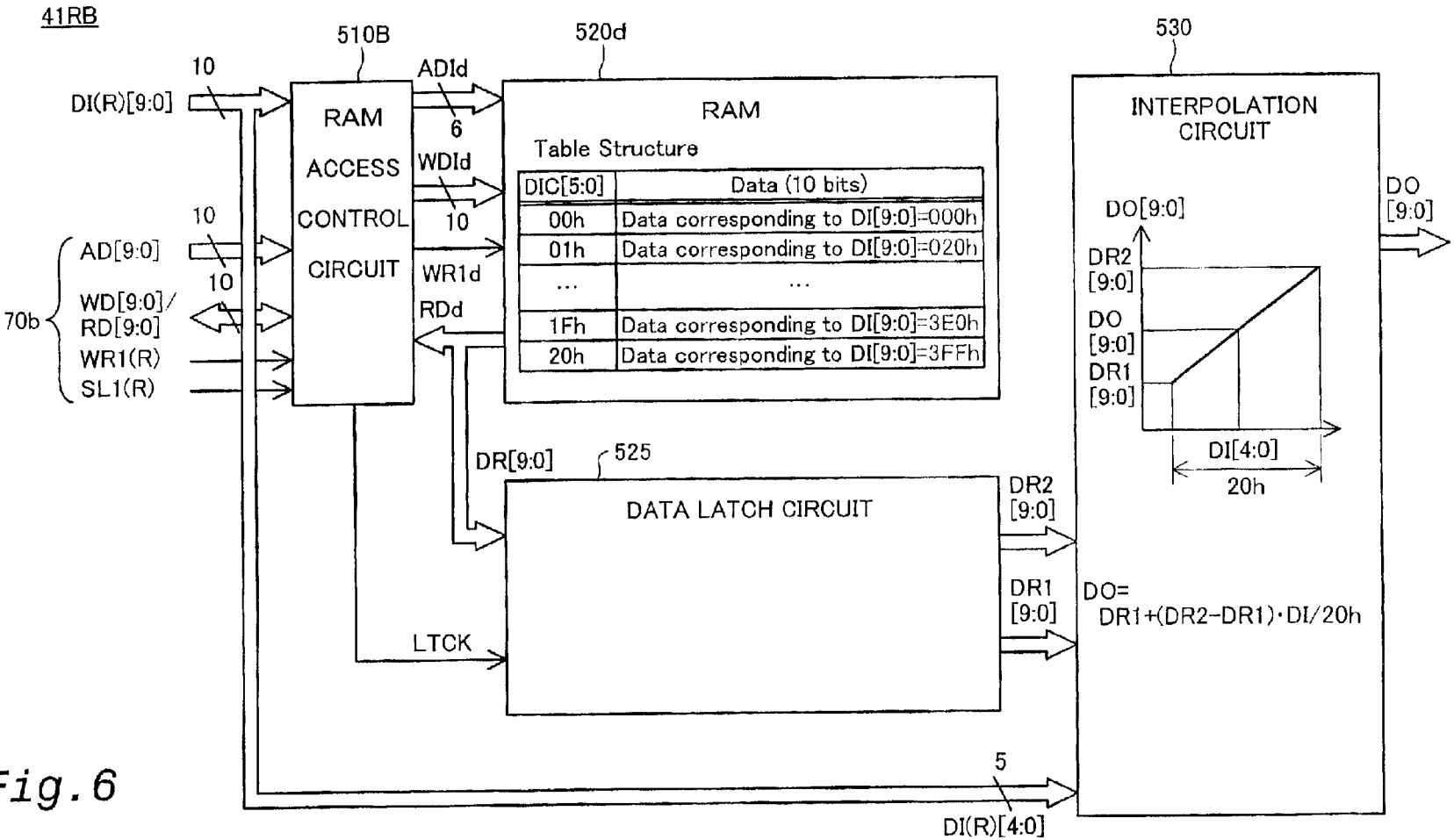
FIG. 6 shows the functionality of still another former stage color signal adjustment module 41RB for the color R in a second modified example.

FIG. 6 shows the functionality of still another former stage color signal adjustment module 41RB for the color R in a second modified example. The former stage color signal adjustment module 41RB includes an access control circuit 510B, one RAM 520*d*, a data latch circuit 525, and the interpolation circuit 530.

As in the former stage color signal adjustment module 41R of the first embodiment, the access control circuit 510B controls access to the RAM 520*d*. A latch clock signal LTCK is supplied to the data latch circuit 525.

The data latch circuit 525 latches a 10-bit output data signal DR [9:0]read from the RAM 520*d* and outputs two reference data signals DR1 and DR2, in response to the latch clock signal LTCK.

Figure 7:
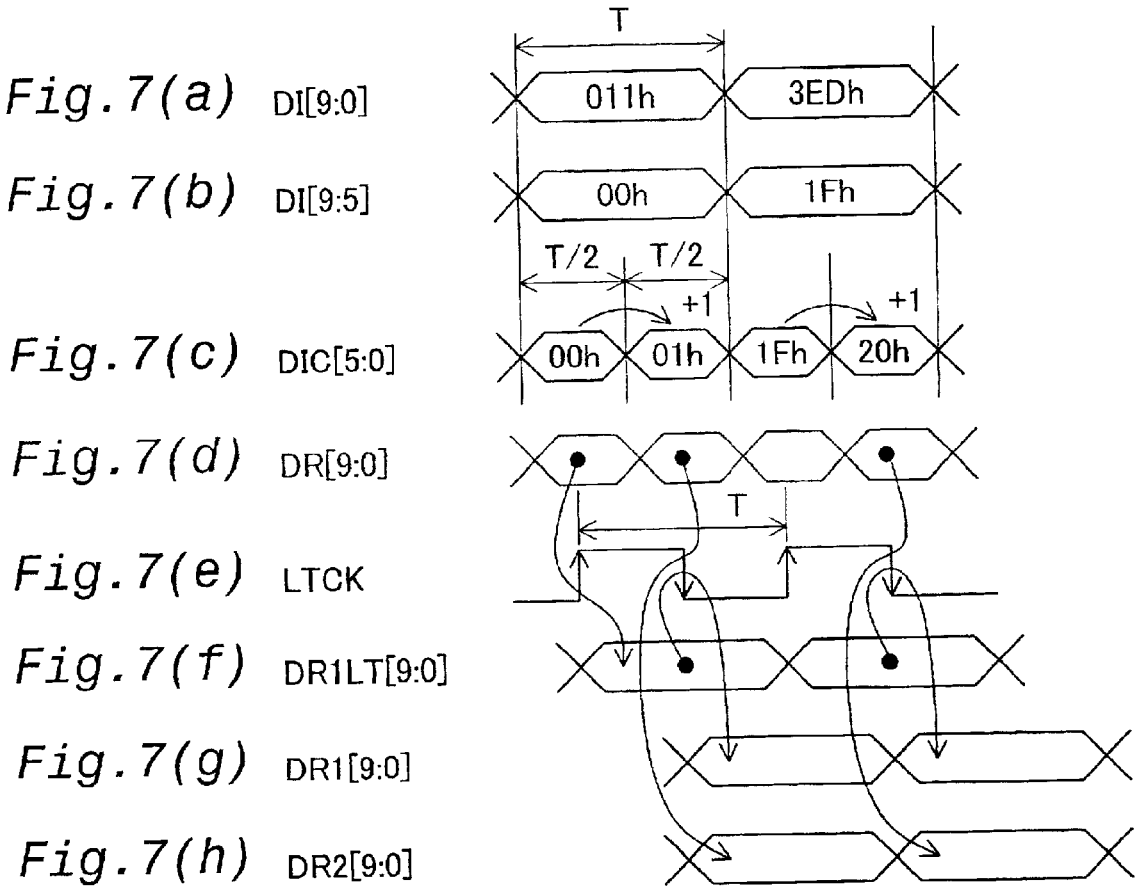
FIGS. 7(*a*) through (*h*) are an output timing chart of two reference data signals DR1 and DR2.

FIGS. 7(*a*) through (*h*) are an output timing chart of the two reference data signals DR1 and DR2. The access control circuit 510B adds 1-bit data to an upper bit and extends an upper 5-bit color video signal DI [9:5] shown in FIG. 7(*b*) to a 6-bit address signal DIC [5:0], in response to input of a color video signal DI [9:0] having a period T as shown in FIG. 7(*a*). This address signal DIC [5:0] has a period T/2, which is equal to half the period T of the color video signal DI, as shown in FIG. 7(*c*). The value of the address signal DIC [5:0] in a first cycle is specified by the color video signal DI [9:5]. The value of the address signal DIC [5:0] in a second cycle is obtained by incrementing the address value in the first cycle by +1. This address signal DIC [5:0] is input into the RAM 520*d* as the input address signal ADId.

The RAM 520*d* outputs a signal DR [9:0] in response to the input address signal DIC [5:0] as shown in FIG. 7(*d*).

The data latch circuit 525 receives input of the latch clock signal LTCK shown in FIG. 7(*e*). The latch clock signal LTCK is a clock signal that is synchronous with the color video signal DI [9:0] and has the period T. The latch clock signal LTCK allows a latch of the signal DR [9:0] read in the first cycle of the address signal DIC [5:0] at the timing of a rising edge, while allowing a latch of the signal DR [9:0] read in the second cycle of the address signal DIC [5:0] at the timing of a falling edge. The latch circuit 525 latches the signal DR [9:0] read in the first cycle of the address signal DIC [5:0] at the timing of the rising edge of the latch clock signal LTCK and generates a latch signal DRILT [9:0] shown in FIG. 7(*f*). The latch circuit 525 further latches the latch signal DRILT [9:0] at the timing of the falling edge of the latch clock signal LTCK and generates a first reference data signal DRI [9:0] shown in FIG. 7(*g*). Simultaneously at the timing of the falling edge of the latch clock signal LTCK, the latch circuit 525 latches the signal DR [9:0] read in the second cycle of the address signal DIC [5:0] and generates a second reference data signal DR2 [9:0] shown in FIG. 7(*h*).

The interpolation circuit 530 shown in FIG. 6 generates data corresponding to the color video signal DI from the respective values of the two reference data signals DR1 and DR2 and the lower 5-bit color video signal DI [5:0] according to the above Equation (2). The data thus generated is output as a former stage-adjusted color video signal DO [9:0].

As described above, whereas the former stage color signal adjustment module 41R of the first embodiment and the former stage color signal adjustment module 41RA of the first modified example use the two RAMs 520*d* and 520*u*, the former stage color signal adjustment module 41RB of this modified example uses only one RAM 520*d*. This arrangement of the second modified example advantageously reduces the size of the circuit structure, compared with the former stage color signal adjustment module 41R of the first embodiment and the former stage color signal adjustment module 41RA of the first modified example. Another advantage of the second modified example is the simple construction of the interpolation circuit as in the former stage color signal adjustment module 41RA of the first modified example.

As clearly understood from the above explanation, the access control circuit 510B corresponds to the signal conversion sub-module of the present invention. The lookup table written in the RAM 520*d* and the data latch circuit 525 correspond to the first lookup table of the present invention.

C. Signal Adjustment Circuit of Second Embodiment

C1. Former Stage Signal Adjustment Module

Figure 8:
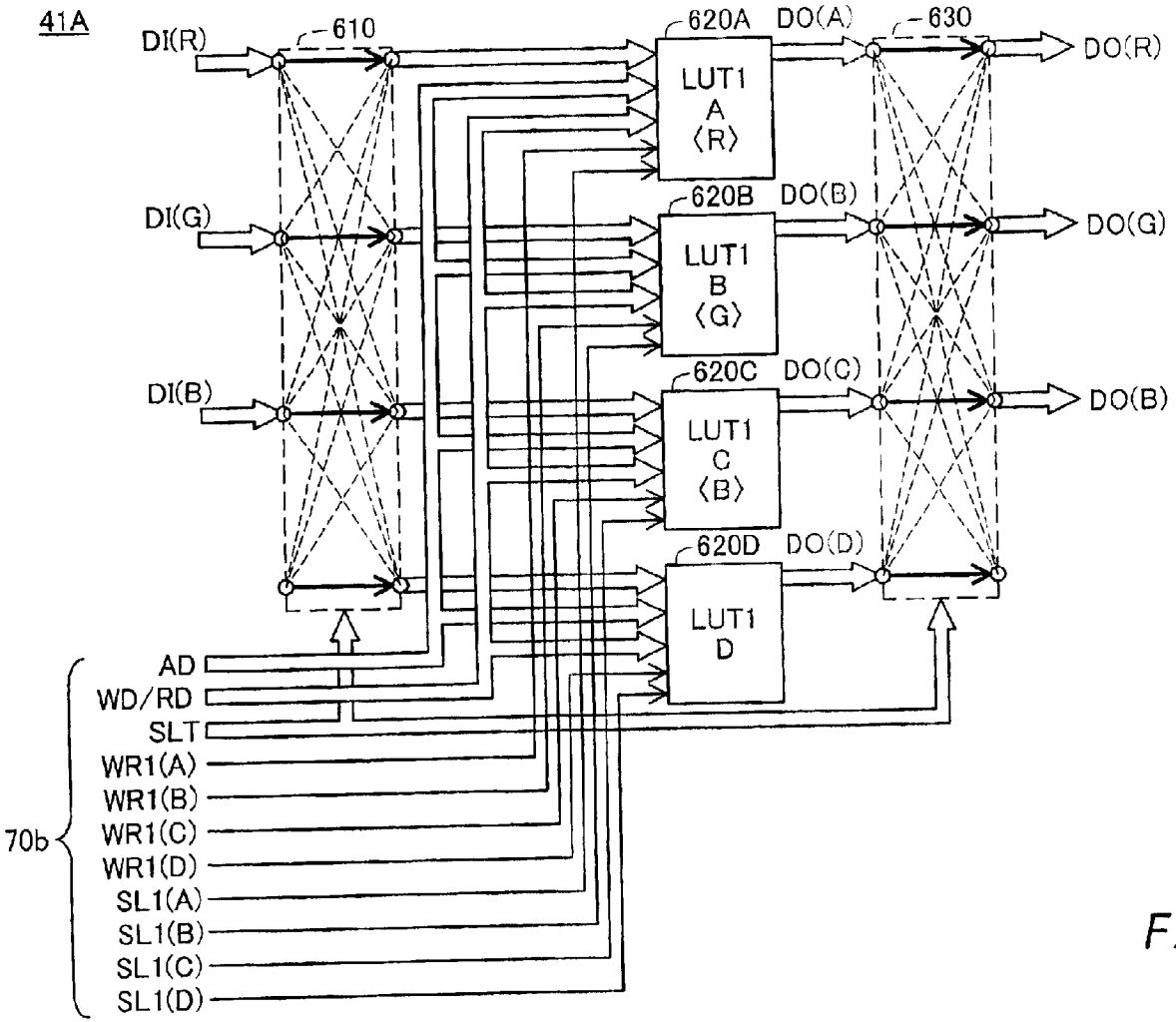
FIG. 8 shows the functionality of a former stage signal adjustment module 41A included in a signal adjustment circuit of a second embodiment.

FIG. 8 shows the functionality of a former stage signal adjustment module 41A included in a signal adjustment circuit of a second embodiment. A latter stage signal adjustment module of the second embodiment has the same structure as that of the latter stage signal adjustment module 42 of the first embodiment (see FIG. 2) and is thus not specifically illustrated nor explained here.

The former stage signal adjustment module 41A includes an input signal selection module 610, four former stage color signal adjustment modules 620A through 620D, and an output signal selection module 630.

The input signal selection module 610 selects three color video signals, that is, an R color video signal DI(R), a G color video signal DI(G), and a B color video signal DI(B), as input signals to arbitrary three former stage color signal adjustment modules selected among the four former stage color signal adjustment modules 620A through 620D, in response to a selection signal SLT.

The output signal selection module 630 selects output signals of the arbitrary three former stage color signal adjustment modules, which have received input of the three color video signals, as former stage-adjusted color video signals DO(R), DO(G), and DO(B) of the corresponding colors, in response to the selection signal SLT. For example, when the R color video signal DI(R) is selected as the input signal to the first former stage color signal adjustment module 620A, the output signal DO(A) of the first former stage color signal adjustment module 620A is selected as the former stage-adjusted R color video signal DO(R).

In the example of FIG. 8, R, G, and B color video signals DI(R), DI(G), and DI(B) are selected in this order as the input signals to the former stage color signal adjustment modules 620A, 620B, and 620C. Output signals DO(A), DO(B), and DO(C) of the former stage color signal adjustment modules 620A, 620B, and 620C are selected in this order as the former stage-adjusted R, G, and B color video signals DO(R), DO(G), and DO(B).

Reading and writing operations of the four former stage color signal adjustment modules 620A through 620D are independently controlled by read-write signals WR1(A) through WR1(D) supplied to the respective modules 620A through 620D. Selection of either the color video signal supplied from the input signal selection module 610 or the address signal AD supplied via the address bus of the bus 70*b* as an input address signal in each of the modules 620A through 620D is independently controlled by each of access changeover signals SL1(A) through SL1(D) supplied to the respective modules 620A through 620D.

Each of the four former stage color signal adjustment modules 620A through 620D may have a structure identical with any of the structures of the former stage color signal adjustment module 41R of the first embodiment (see FIG. 4), the former stage color signal adjustment module 41RA of the first modified example, and the former stage color signal adjustment module 4lRb of the second modified example. The structure and the operations of the respective former stage color signal adjustment modules 620A through 620D are omitted here.

C2. Settings of Lookup Table

As shown in FIG. 8, in the initial settings, the input signal selection module 610 selects the R, G, and B color video signals DI(R), DI(G), and DI(B) as the input signals to the first through the third former stage color signal adjustment modules 620A through 620C. The output signal selection module 630 selects the output signals DO(A), DO(B), and DO(C) of the first through the third former stage color signal adjustment modules 620A through 620C as the former stage-adjusted R, G, and B color video signals DO(R), DO(G), and DO(B). The lookup tables corresponding to the tone characteristics of the R, G, and B color video signals are set in the first through the third former stage color signal adjustment modules 620A through 620C. The symbols <R>, <G>, and <B> attached to the first through the third former stage color signal adjustment modules 620A through 620C represent that the lookup tables for the colors R, G, and B have been set respectively. No lookup table has been set in the fourth former stage color signal adjustment module 620D.

As described in the first embodiment, the settings of the lookup tables are performed in the sequence of the former stage color signal adjustment modules among the four former stage color signal adjustment modules 620A through 620D, in which the access with the address signal AD supplied via the bus 70*b* is selected in response to each of the input access changeover signals SL1(A) through SL1(C).

Each of the lookup tables is rewritten and updated from the initial settings according to the procedure discussed below.

Figure 9:
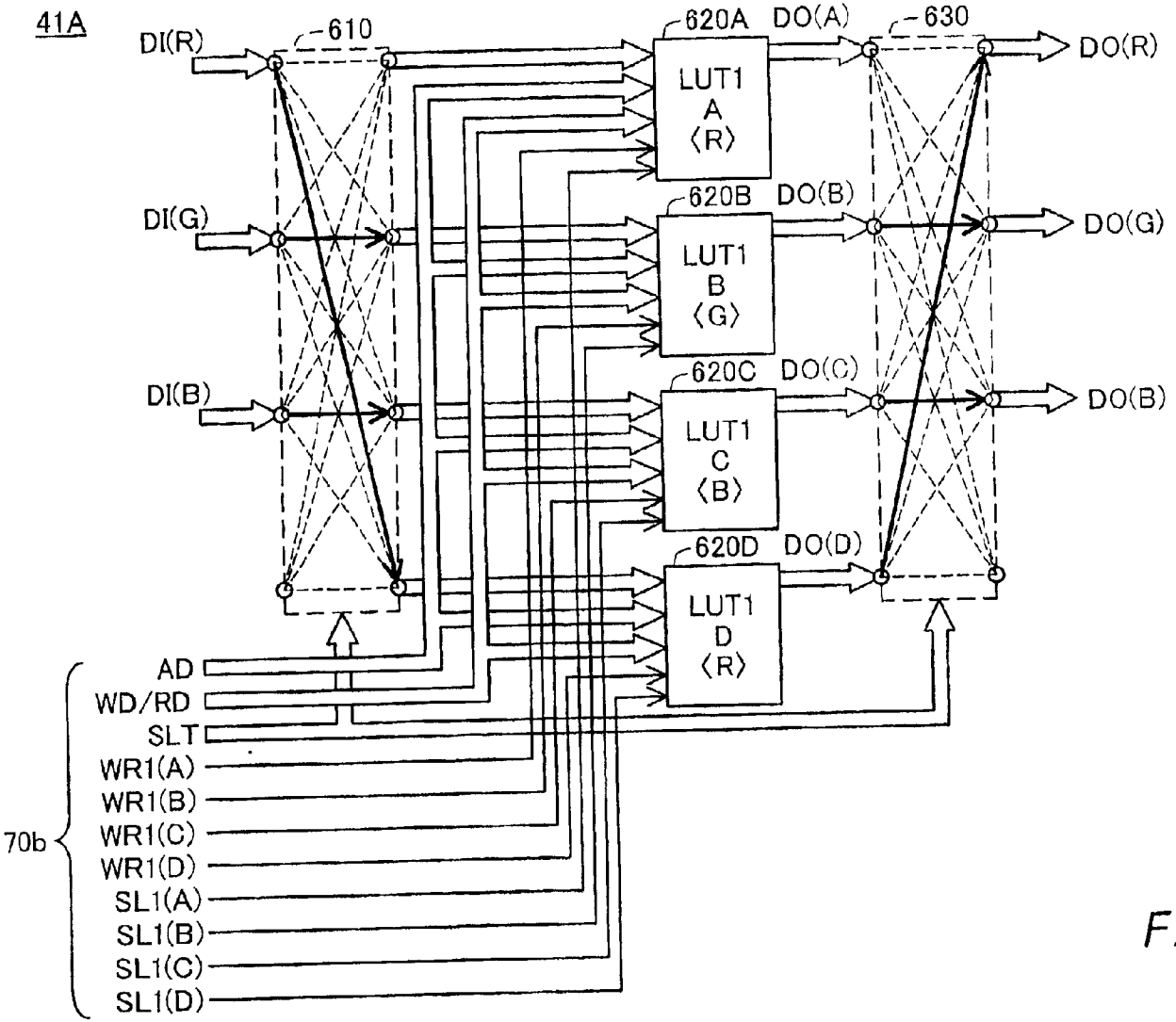
FIG. 9 shows the functionality of the former stage signal adjustment module 41A after updating a lookup table for the color R.

In the former stage signal adjustment module 41A of FIG. 8, the fourth former stage color signal adjustment module 620D is in a vacant state. The updated lookup table for the color R is accordingly set in the fourth former stage color signal adjustment module 620D, which has been in the vacant state. FIG. 9 shows the functionality of the former stage signal adjustment module 41A after updating the lookup table for the color R. Since the new lookup table for the color R has been set in the fourth former stage color signal adjustment module 620D, the input signal selection module 610 selects the R color video signal DI(R) as the input address signal to the fourth former stage color signal adjustment module 620D. The output signal selection module 630 selects the output signal DO(D) of the fourth former stage color signal adjustment module 620D as the former stage-adjusted R color video signal DO(R).

Figure 10:
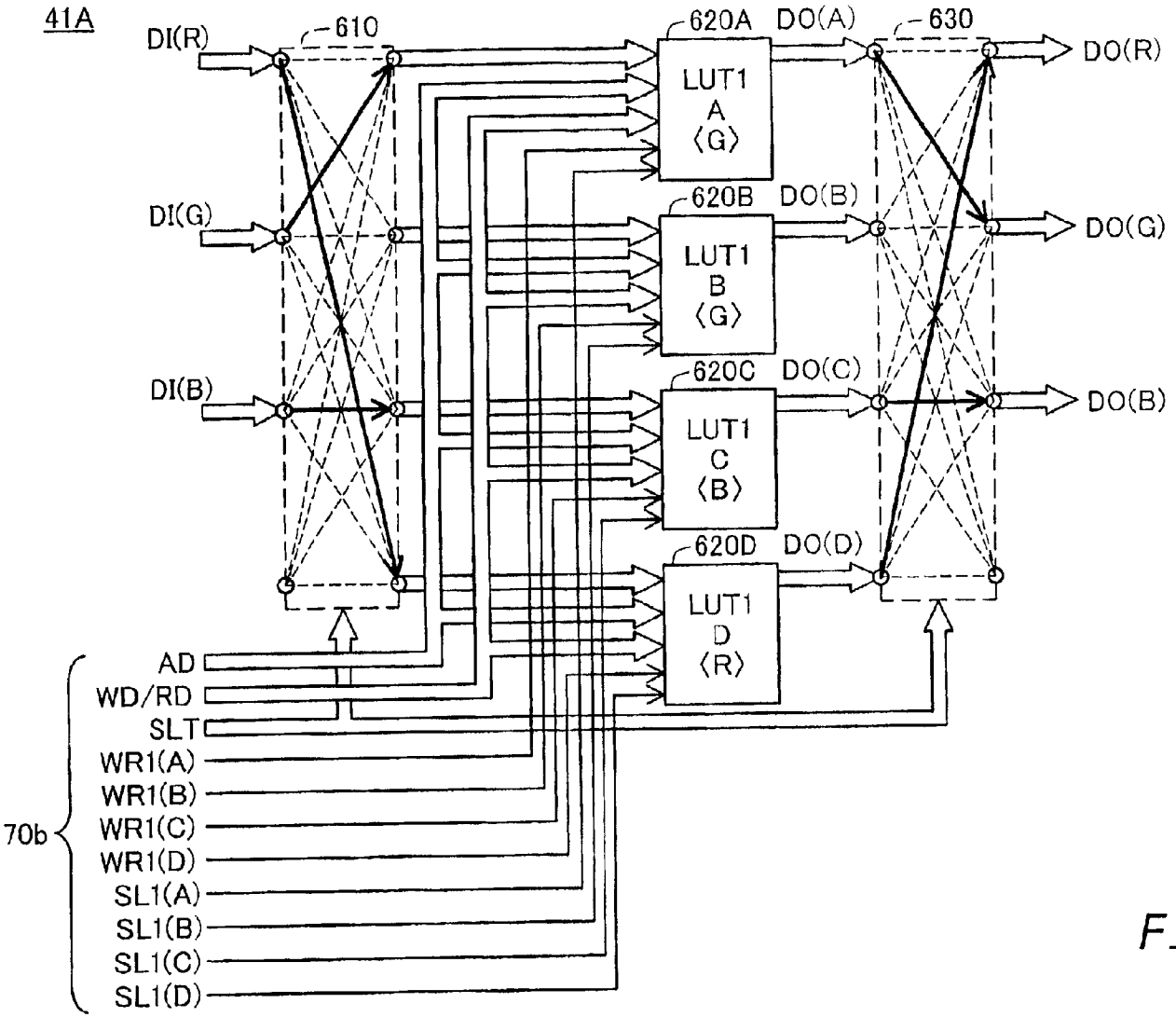
FIG. 10 shows the functionality of the former stage signal adjustment module 41A after updating a lookup table for a color G.

In the state of FIG. 9, the non-updated, old lookup table for the color R, which is not required, is still present in the first former stage color signal adjustment module 620A. The updated lookup table for the color G is accordingly set in the first former stage color signal adjustment module 620A. FIG. 10 shows the functionality of the former stage signal adjustment module 41A after updating the lookup table for the color G. Since the new lookup table for the color G has been set in the first former stage color signal adjustment module 620A, the input signal selection module 610 selects the G color video signal DI(G) as the input address signal to the first former stage color signal adjustment module 620A. The output signal selection module 630 selects the output signal DO(A) of the first former stage color signal adjustment module 620A as the former stage-adjusted G color video signal DO(G).

Figure 11:
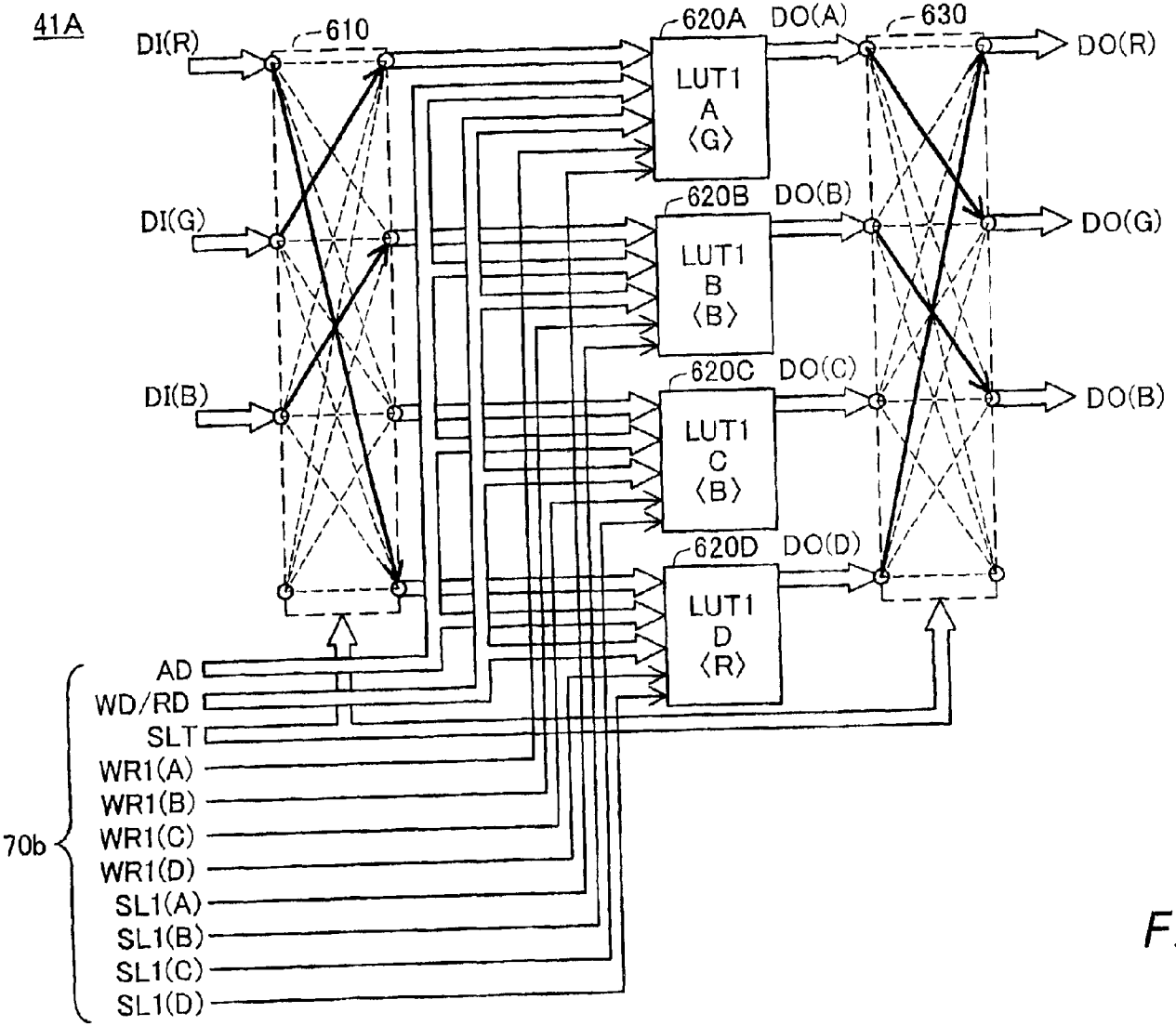
FIG. 11 shows the functionality of the former stage signal adjustment module 41A after updating a lookup table for a color B.

In the state of FIG. 10, the non-updated, old lookup table for the color G, which is not required, is still present in the second former stage color signal adjustment module 620B. The updated lookup table for the color B is accordingly set in the second former stage color signal adjustment module 620B. FIG. 11 shows the functionality of the former stage signal adjustment module 41A after updating the lookup table for the color B. Since the new lookup table for the color B has been set in the second former stage color signal adjustment module 620B, the input signal selection module 610 selects the B color video signal DI(B) as the input address signal to the second former stage color signal adjustment module 620B. The output signal selection module 630 selects the output signal DO(B) of the second former stage color signal adjustment module 620B as the former stage-adjusted B color video signal DO(B).

As described above, the updated, new lookup table for one color is set in one former stage color signal adjustment module in the vacant state, among the four former stage color signal adjustment modules 620A through 620D. This procedure sequentially makes one of the former stage color signal adjustment modules fall in the non-required state. The procedure successively utilizes the former stage color signal adjustment modules in the non-required state to update all the lookup tables for the respective colors.

The former stage color signal adjustment modules in the non-required state are utilized to rewrite and update the lookup tables. This arrangement effectively prevents the potential noise, which occurs in the course of directly rewriting the lookup table set in each former stage color signal adjustment module. This arrangement also enables the resulting image to be continuously displayed in response to the color signal via the non-updated, old lookup table even during the rewriting operation of the lookup table. This effectively prevents a significant change in color of the resulting image.

The above procedure of rewriting and updating the lookup tables is on the assumption that the lookup tables for the respective colors R, G, and B have initially been stored in the first through the third former stage color signal adjustment modules 620A through 620D. The procedure is, however, not restricted to such assumption, but is applicable to any case in which the lookup tables for the respective colors R, G, and B have been set in any three former stage color signal adjustment modules selected among the four former stage color signal adjustment modules 620A through 620D. The above embodiment regards the procedure of rewiring and updating all the lookup tables for the respective colors. The technique of this embodiment is also applicable to the procedure of rewiring and updating any one or two lookup tables.

D. Other Applications

The above embodiments and applications are to be considered in all aspects as illustrative and not restrictive. There may be many modifications, changes, and alterations without departing from the scope or spirit of the main characteristics of the present invention. Some examples of possible modification and application are given below.

The above embodiments regard the projector that utilizes the transmission-type liquid crystal panel as the image display module. The technique of the present invention is also applicable to other types of projectors, for example, those utilizing a reflection-type liquid crystal panel, those utilizing a digital micromirror device (trade mark by Texas Instruments, Inc.), and those utilizing a CRT. The present invention is not restricted to the projectors but may be applicable to a diversity of image display apparatuses including direct vision-type image display apparatuses.

The technique of the present invention may be actualized by other applications. A first application is an image display apparatus that displays an image based on an input video signal. The image display apparatus includes: a signal adjustment device that adjusts a tone characteristic of the input video signal and outputs an adjusted video signal; and an electro-optic device that outputs image light representing the image in response to the adjusted video signal supplied from the signal adjustment device. The signal adjustment device has: a former stage signal adjustment module that adjusts the tone characteristic of the input video signal, based on first adjustment information regarding an input-output characteristic of the image display apparatus; and a latter stage signal adjustment module that adjusts a tone characteristic of a former stage-adjusted video signal supplied from the former stage signal adjustment module, based on second adjustment information regarding the input-output characteristic of the image display apparatus. The former stage signal adjustment module includes: a signal conversion sub-module that outputs an upper q-bit video signal (where q is an integer of not less than 1 and not greater than (p−1)) in response to input of a p-bit video signal (where p is an integer of not less than 2); a first lookup table that has information representing a mapping of a tone value expressed by the upper q-bit video signal to an r-bit tone value (where r is an integer of not less than p) set according to the first adjustment information, the first lookup table outputting an r-bit first reference signal, which represents a lower tone value than a tone value corresponding to the p-bit video signal, and an r-bit second reference signal, which represents a tone value higher than the tone value corresponding to the p-bit video signal, in response to input of the upper q-bit video signal from the signal conversion sub-module; and an interpolation sub-module that interpolates and generates an r-bit former stage-adjusted video signal corresponding to the p-bit video signal, based on the first reference signal and the second reference signal. The latter stage signal adjustment module includes a second lookup table that has information representing a mapping of an r-bit tone value expressed by the former stage-adjusted video signal supplied from the former stage signal adjustment module to an r-bit tone value set according to the second adjustment information.

A second application is a signal adjustment device that adjusts a tone characteristic of an input video signal. The signal adjustment device has: a former stage signal adjustment module that adjusts the tone characteristic of the input video signal, based on first adjustment information regarding a predetermined characteristic; and a latter stage signal adjustment module that adjusts a tone characteristic of a former stage-adjusted video signal supplied from the former stage signal adjustment module, based on second adjustment information regarding the predetermined characteristic. The former stage signal adjustment module includes: a signal conversion sub-module that outputs an upper q-bit video signal (where q is an integer of not less than 1 and not greater than (p−1)) in response to input of a p-bit video signal (where p is an integer of not less than 2); a first lookup table that has information representing a mapping of a tone value expressed by the upper q-bit video signal to an r-bit tone value (where r is an integer of not less than p) set according to the first adjustment information, the first lookup table outputting an r-bit first reference signal, which represents a lower tone value than a tone value corresponding to the p-bit video signal, and an r-bit second reference signal, which represents a tone value higher than the tone value corresponding to the p-bit video signal, in response to input of the upper q-bit video signal from the signal conversion sub-module; and an interpolation sub-module that interpolates and generates an r-bit former stage-adjusted video signal corresponding to the p-bit video signal, based on the first reference signal and the second reference signal. The latter stage signal adjustment module includes a second lookup table that has information representing a mapping of an r-bit tone value expressed by the former stage-adjusted video signal supplied from the former stage signal adjustment module to an r-bit tone value set according to the second adjustment information.

All changes within the meaning and range of equivalency of the claims are intended to be embraced therein. The scope and spirit of the present invention are indicated by the appended claims, rather than by the foregoing description.

What is claimed is:

1. An image display apparatus that displays an image based on an input video signal, said image display apparatus comprising:

a signal adjustment device that adjusts a tone characteristic of the input video signal and outputs an adjusted video signal; and an electro-optic device that outputs image light representing the image in response to the adjusted video signal supplied from said signal adjustment device, said signal adjustment device comprising a former stage signal adjustment module including first through third former stage color signal adjustment modules, and a latter stage signal adjustment module including first through third latter stage color signal adjustment modules, said first through third former stage color signal adjustment modules respectively adjusting tone characteristics of first through third color video signals, which are constituents of the input video signal, based on first adjustment information regarding an input-output characteristic of said image display apparatus; and said first through third latter stage color signal adjustment modules respectively adjusting tone characteristics of first through third former stage-adjusted color video signals supplied from said first through third former stage color signal adjustment modules, based on second adjustment information regarding the input-output characteristic of said image display apparatus, wherein each of said first through third former stage color signal adjustment modules comprises:

a signal conversion sub-module that outputs an upper q-bit color video signal, where q is an integer of not less than 1 and not greater than (p−1), in response to input of a corresponding p-bit color video signal, where p is an integer of not less than 2;

a first lookup table that stores information representing a mapping of a tone value expressed by the upper q-bit color video signal to an r-bit tone value set according to the first adjustment information, where r is an integer of not less than p, said first lookup table outputting, in response to input of the upper q-bit color video signal from said signal conversion sub-module, an r-bit first reference signal, which represents a lower tone value than a tone value corresponding to the p-bit color video signal, and an r-bit second reference signal, which represents a higher tone value than the tone value corresponding to the p-bit color video signal; and an interpolation sub-module that interpolates and generates an r-bit former stage-adjusted color video signal corresponding to the p-bit color video signal, based on the first reference signal and the second reference signal, each of said first through third latter stage color signal adjustment modules comprising:

a second lookup table that stores information representing a mapping of an r-bit tone value expressed by the former stage-adjusted color video signal supplied from its corresponding former stage color signal adjustment module to an r-bit tone value set according to the second adjustment information.

2. An image display apparatus in accordance with claim 1, said image display apparatus further comprising:

an adjustment controller that controls said signal adjustment device, wherein said former stage signal adjustment module comprises:

four former stage color signal adjustment modules that are usable to adjust the first through the third color video signals constituting the input video signal;

an input signal selection sub-module that selects the first through the third color video signals as input signals to arbitrary three former stage color signal adjustment modules, which are selected among said four former stage color signal adjustment modules, in response to a preset selection signal output from said adjustment controller; and an output signal selection sub-module that selects three output signals from said three former stage color signal adjustment modules, which have received the input of the first through the third color video signals, as the first through the third former stage-adjusted color video signals in response to the preset selection signal.

3. An image display apparatus in accordance with claim 1, wherein the second adjustment information is utilized to correct a non-linear input-output characteristic of said image display apparatus, which arises due to a non-linear input-output characteristic intrinsic to said electro-optic device.

4. An image display apparatus in accordance with claim 1, wherein the first adjustment information is utilized to correct the input-output characteristic of said image display apparatus, in order to attain a user's desired property relating to the image displayed by said image display apparatus.

5. An image display apparatus in accordance with claim 4, wherein the user's desired property includes at least one property among contrast, brightness, and color of the image displayed by said image display apparatus.

6. An image display apparatus in accordance with claim 2, wherein the second adjustment information is utilized to correct a non-linear input-output characteristic of said image display apparatus, which arises due to a non-linear input-output characteristic intrinsic to said electro-optic device.

7. An image display apparatus in accordance with claim 2, wherein the first adjustment information is utilized to correct the input-output characteristic of said image display apparatus, in order to attain a user's desired property relating to the image displayed by said image display apparatus.

8. An image display apparatus in accordance with claim 7, wherein the user's desired property includes at least one property among contrast, brightness, and color of the image displayed by said image display apparatus.

9. An image display apparatus in accordance with claim 3, wherein the first adjustment information is utilized to correct the input-output characteristic of said image display apparatus, in order to attain a user's desired property relating to the image displayed by said image display apparatus.

10. An image display apparatus in accordance with claim 9, wherein the user's desired property includes at least one property among contrast, brightness, and color of the image displayed by said image display apparatus.

11. A signal adjustment device that adjusts an input video signal, said signal adjustment device comprising a former stage signal adjustment module including first through third former stage color signal adjustment modules, and a latter stage signal adjustment module including first through third latter stage color signal adjustment modules, said first through third former stage color signal adjustment modules respectively adjusting tone characteristics of first through third color video signals, which are constituents of the input video signal, based on first adjustment information regarding a predetermined characteristic; and said first through third latter stage color signal adjustment modules respectively adjusting tone characteristics of first through third former stage-adjusted color video signals supplied from said first through third former stage color signal adjustment modules, based on second adjustment information regarding the predetermined characteristic, wherein each of said first through third former stage color signal adjustment modules comprises:

a signal conversion sub-module that outputs an upper q-bit color video signal, where q is an integer of not less than 1 and not greater than (p−1), in response to input of a corresponding p-bit color video signal, where p is an integer of not less than 2;

a first lookup table that stores information representing a mapping of a tone value expressed by the upper q-bit color video signal to an r-bit tone value set according to the first adjustment information, where r is an integer of not less than p, said first lookup table outputting, in response to input of the upper q-bit color video signal from said signal conversion sub-module, an r-bit first reference signal, which represents a lower tone value than a tone value corresponding to the p-bit color video signal, and an r-bit second reference signal, which represents a higher tone value than the tone value corresponding to the p-bit color video signal; and an interpolation sub-module that interpolates and generates an r-bit former stage-adjusted color video signal corresponding to the p-bit color video signal, based on the first reference signal and the second reference signal, each of said first through third latter stage color signal adjustment modules comprising:

a second lookup table that stores information representing a mapping of an r-bit tone value expressed by the former stage-adjusted color video signal supplied from its corresponding former stage color signal adjustment module to an r-bit tone value set according to the second adjustment information.

12. A signal adjustment device in accordance with claim 11, wherein said former stage signal adjustment module comprising:

four former stage color signal adjustment modules that are usable to adjust the first through the third color video signals constituting the input video signal;

an input signal selection sub-module that selects the first through the third color video signals as input signals to arbitrary three former stage color signal adjustment modules, which are selected among said four former stage color signal adjustment modules, in response to a preset selection signal output from said adjustment controller; and an output signal selection sub-module that selects three output signals from said three former stage color signal adjustment modules, which have received the input of the first through the third color video signals, as the first through the third former stage-adjusted color video signals in response to the preset selection signal.

* * * * *